United States Patent [19]

Moberly

[11] 3,965,515

[45] June 29, 1976

[54] BOOT STRETCHER

[75] Inventor: George H. Moberly, Colorado Springs, Colo.

[73] Assignee: The Moberly Company, Colorado Springs, Colo.

[22] Filed: Dec. 30, 1974

[21] Appl. No.: 537,362

[52] U.S. Cl. ..... 12/114.6
[51] Int. Cl.[2] ..... A43D 5/00
[58] Field of Search ..... 12/114.6, 116.8, 117.2, 12/115.6

[56] References Cited

UNITED STATES PATENTS

| | | | |
|---|---|---|---|
| 164,496 | 6/1875 | Turneauve | 12/114.6 |
| 1,828,937 | 10/1931 | Niemi | 12/114.6 |
| 2,006,419 | 7/1935 | Thomas | 12/114.6 |

*Primary Examiner*—Patrick D. Lawson
*Attorney, Agent, or Firm*—Richard W. Hanes

[57] ABSTRACT

A boot stretcher for selectively stretching portions of a foot boot which includes a body generally conforming in its shape to the shape within a boot wherein the body includes anterior and posterior halves and including a pair of screw jacks interconnected the said body halves which can selectively be operated to spread apart the body halves for a stretching operation.

6 Claims, 5 Drawing Figures

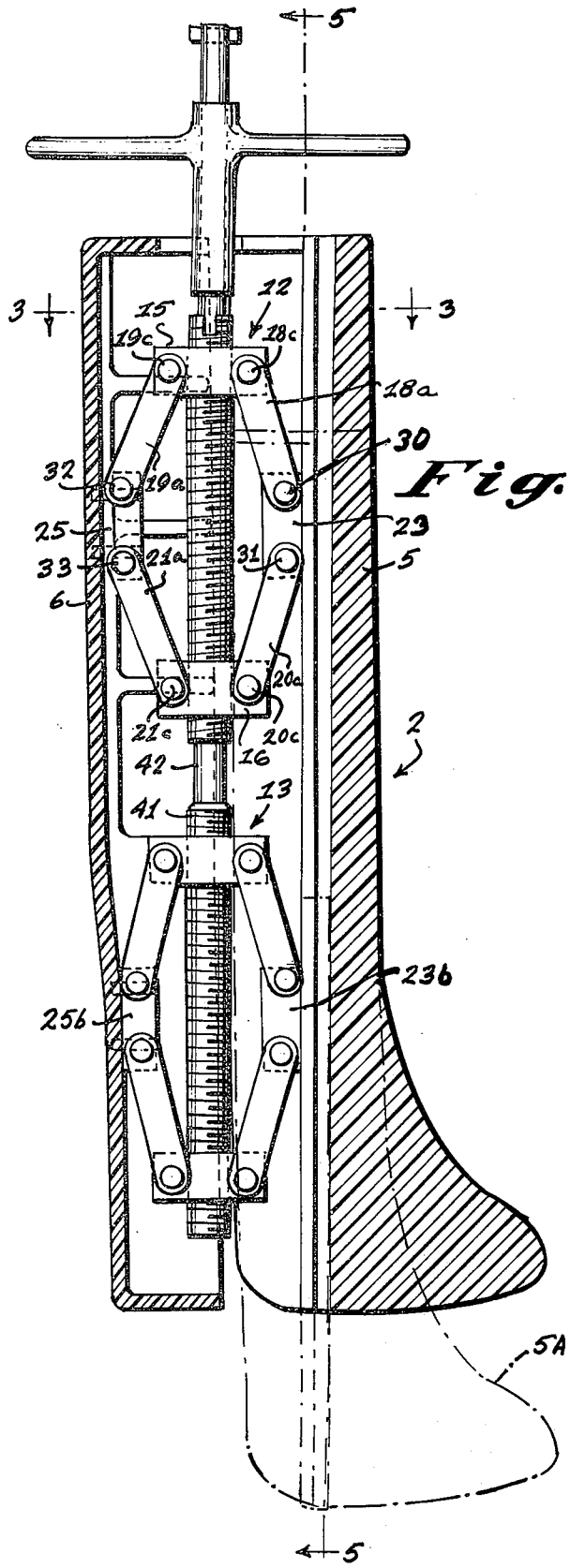
Fig. 1
Fig. 2
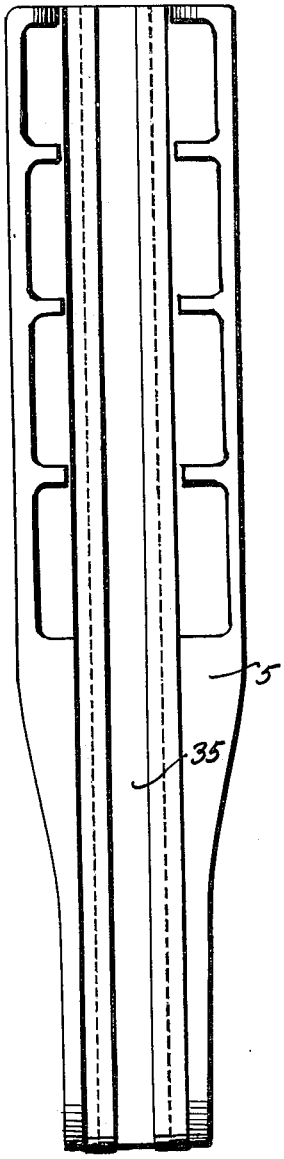
Fig. 3
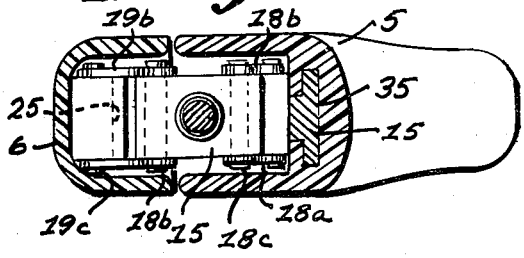

BOOT STRETCHER

Peculiar problems arise in the fitting of certain kinds of foot boots which do not have tieing laces or buckles, such as for example, "western style" or "riding" boots. This type of boot typically comprises a foot portion with an elongated upper portion which may extend from half to full calf in length. Since the boot is essentially a one-piece structure and there are no means for the wearer to adjust the boot, additional fitting problems are encountered. After a proper foot fit is obtained, discomfort may still be present from too tight a fit in such areas as the instep, the ankle, and the calf.

It is therefore the primary object of the present invention to provide a mechanical apparatus for stretching or enlarging portions of a tieless foot boot for improving the fit.

More specifically, the object of the invention is to provide a boot stretcher which can selectively be adjusted for enlarging the instep, the ankle or the calf portion of the boot.

Other features of the boot stretcher construction will become apparant upon a reading of the following detailed description of a preferred form of the invention taken together with the accompanying drawings in which:

FIG. 1 is a cross-sectional side view of the boot stretcher of the present invention with an alternate position of a portion thereof shown in phantom lines.

FIG. 2 is an inside front view of the anterior half of the stretcher body.

FIG. 3 is a cross-sectional view of the boot stretcher taken along line 3—3 of FIG. 1.

The boot stretcher 2 of the present invention is constructed from a smooth-surfaced, rigid material having appropriate strength. It is constructed to generally simulate the shape of a boot except for a substantially reduced foot length. The body of the stretcher comprises anterior and posterior halves, 5 and 6 respectively, which are interconnected by screw-driven expansion links for spreading and bringing together the body halves.

Figure 4:
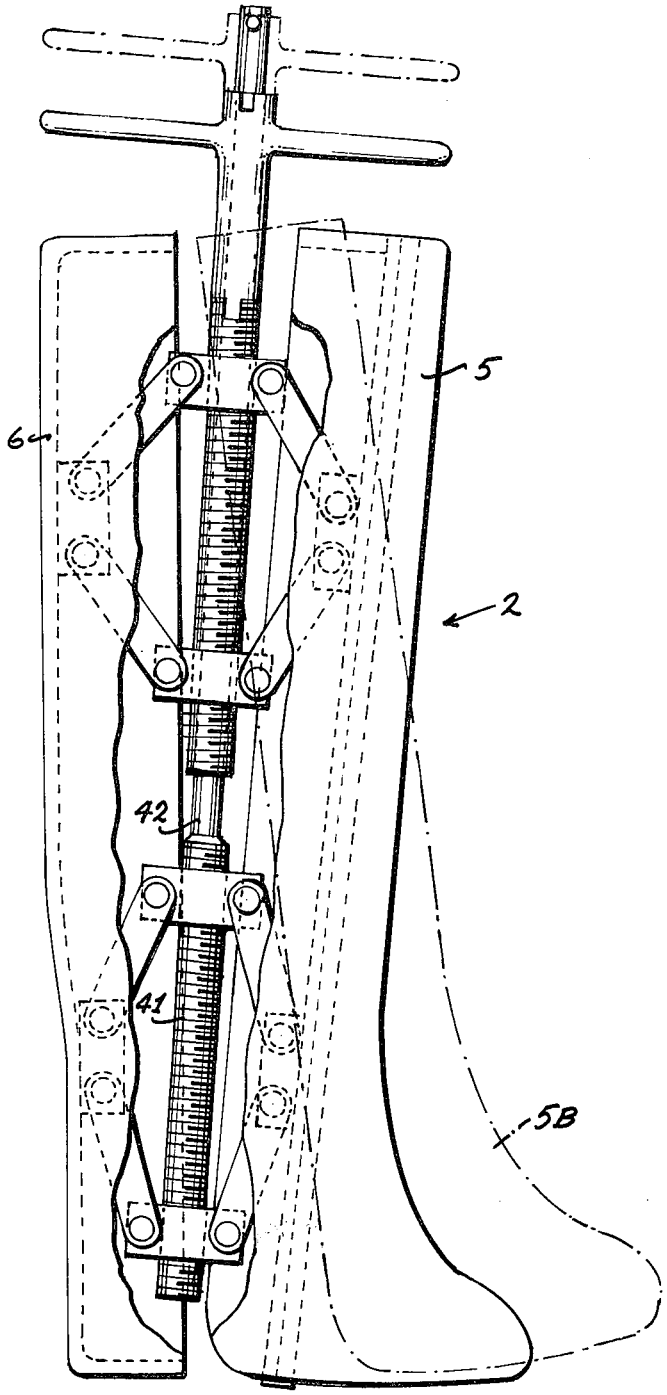
FIG. 4 is a side elevational view of the boot stretcher with a portion thereof broken away to reveal the interior mechanism thereof and with an alternate position of a portion thereof shown in phantom lines.
Figure 5:
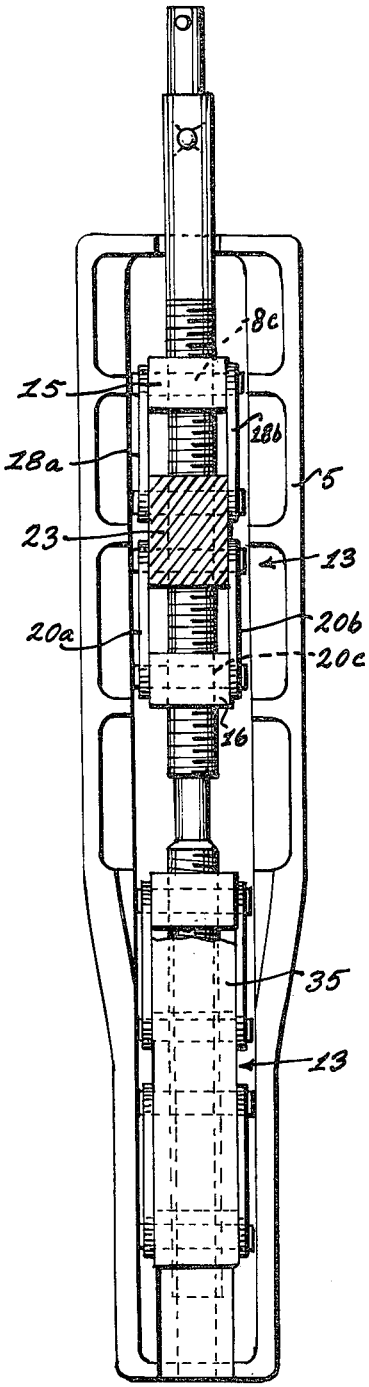
FIG. 5 is a cross-sectional view of the boot stretcher taken along line 5—5 of FIG. 1.

To better reveal the details of construction, the modes of operation should first be understood. The cross-sectional view of FIG. 4 illustrates a neutral or beginning position, typical of that which would be assumed when the devise is inserted into the boot. In this position, the anterior and posterior halves 5 and 6 are adjusted to be in close proximity to one another so that insertion into the leg portion of the boot will be facilitated.

If enlargement of the instep of the boot is sought, the stretching force should preferrably be applied in a direction substantially perpendicular to the surface, which, at the instep of the boot, is curved to fit the curved surface of the top of the foot just above the instep. To produce such a stretching force, the anterior half 5 of the stretcher 2 is lowered with respect to the posterior half (see anterior half 5A shown in phantom lines, FIG. 4) to such an extent that the curved frontal surface of the anterior half fits snugly against the curved upper foot portion of the boot which is sought to be enlarged while the posterior portion fits snugly against the back of the boot. As the handle 10 is turned, the toe portion of the anterior half 5 moves outwardly from the posterior half, resulting in a stretching force being applied to the instep of the boot.

If the ankle enclosing portion of the boot is the object of the enlargement, it is probably not necessary to slide or adjust the two halves longitudinally as described above (FIG. 1), however such adjustment can always be made to more closely conform the stretcher 2 to the boot which is being worked on. Once again, the boot is stretched by turning the handle 10 in such a manner that only the lower portion of the two body halves will move outwardly with respect to one another, thus applying a stretching force to the ankle portion of the boot leg. (See the phantom view 5B in FIG. 4)

Similarly, upper calf enlargement is accomplished on a boot leg by inserting the stretcher 2 into the boot to the desired point and operating the handle mechanism in such a manner that the upper portions of the anterior and posterior halves move outwardly with respect to each other. (See FIG. 4)

The variations of stretching forces are obtained by a novel screw drive mechanism which acts to interconnect the body halves in such a manner that the selective adjustment described above can be accomplished.

A pair of expansion jacks (upper 12 and lower 13) are longitudinally spaced apart along the leg portion of the stretcher. Both jacks 12 and 13 are similar and hence only one will be referred to in detail. The jack 12 comprises a spaced apart pair of threaded nuts 15 and 16. To each nut is pivotally connected an anterior and posterior pair of links 18*a*, 18*b*, 19, 19*a*, 20*a*, 20*b*, 21*a*, and 21*b*, which are secured to their respective nuts by means of a spindle 18*c*, 19*c*, 20*c*, and 21*c*. Each anterior pair of links (18 and 20) are interconnected by a jack pad 23. Each posterior pair of links 19 and 21 are interconnected by a jack pad 25. The jack pads 23 and 25 are pivotally connected to the links by spindles 30, 31, 32, and 33.

The posterior jack pad 25 (25*b* for the lower jack 13) is fixedly secured to the posterior body half 6, while the anterior jack pads 23 and 23*b* are slideably mounted in dovetail channel 35 longitudinally disposed along the inside of the anterior body half 5. The slideable mounting of the anterior jack pads 23 and 23*b* permits the anterior body half to be moved longitudinally with respect to the posterior half.

The jacks 12 and 13 are expanded and contracted with a rotating screw in a manner well known to the art. To accomplish the selective adjustment of the stretcher of the present invention, however, each jack is provided with its own lead screw.

The lower jack 13 is operated by a lead screw 41 which is equipped with an extended drive shaft 42 of reduced diameter which runs up between the body halves and projects from the top of the stretcher body.

The upper jack 12 is operated by a lead screw 45 which is tubular in its construction and is coaxially mounted for rotation on the drive shaft 42 of the lower lead screw 41.

Also coaxially mounted on the drive shaft 42 is the handle 10 which may be moved axially along the shaft to either of two positions. In its lower operating position, an ear 46 projecting from the shank 47 of the handle 10 is sized and positioned to engage a mating slot 49 in the top portion of the upper lead screw 45. Thus engaged, the handle may turn the upper lead screw and operate the upper expansion jack 12. (See the solid line illustration of FIG. 4.) In its upper operating position, a notch 51 in the tip of the handle shank engages a protruding pin 53 fixed in the upper extremity of the lower lead screw drive shaft 42. Thus engaged, the handle may be made to turn the lower lead screw and the lower jack 13. (See the phantom line illustration of FIG. 4.)

I claim:

1. Apparatus for selectively stretching portions of a foot boot comprising:

a body generally conforming in its shape to the space within a boot, including a shortened foot portion, said body comprising anterior and posterior halves;

upper and lower expandable connecting means interconnecting the said body halves; and means selectively engageable with the said upper and lower connecting means to expand the said connecting means and spread apart the said body halves.

2. Apparatus for selectively stretching portions of a foot boot comprising:

a body generally conforming in its shape to the space within a boot, including a shortened foot portion, said body comprising anterior and posterior halves;

upper and lower expandable connecting means interconnecting the said body halves; and means selectively engageable with the said upper and lower connecting means to expand the said connecting means and spread apart the said body halves; and means slideably mounting the said connecting means to the said anterior body half.

3. The apparatus of claim 2 wherein the connecting means each comprise a screw jack disposed so that its direction of movement is substantially perpendicular to the longitudinal line of division between the body halves.

4. The apparatus of claim 3 wherein the means to expand the connecting means includes first and second lead screws threadingly engaged to the upper and lower screw jacks respectively.

5. The apparatus of claim 4 and further including a drive shaft integral with said second lead screw and wherein said drive shaft coaxially carries the said first lead screw.

6. The apparatus of claim 5 and further including handle means carried by said drive shaft and means operably engaging the handle means to the said first lead screw and means operably engaging the handle means to the said drive shaft.

* * * * *